US009850714B2

(12) United States Patent
Livescu et al.

(10) Patent No.: US 9,850,714 B2
(45) Date of Patent: Dec. 26, 2017

(54) REAL TIME STEERABLE ACID TUNNELING SYSTEM

(71) Applicant: Baker Hughes Incorporated, Houston, TX (US)

(72) Inventors: Silviu Livescu, Calgary (CA); Thomas J. Watkins, Calgary (CA)

(73) Assignee: BAKER HUGHES, A GE COMPANY, LLC

( * ) Notice: Subject to any disclaimer, the term of this patent is extended or adjusted under 35 U.S.C. 154(b) by 359 days.

(21) Appl. No.: 14/710,926

(22) Filed: May 13, 2015

(65) Prior Publication Data

US 2016/0333640 A1 Nov. 17, 2016

(51) Int. Cl.

| | |
|---|---|
| ***E21B 7/18*** | (2006.01) |
| ***E21B 7/06*** | (2006.01) |
| ***E21B 47/024*** | (2006.01) |
| ***E21B 43/28*** | (2006.01) |
| ***E21B 17/20*** | (2006.01) |
| ***E21B 47/12*** | (2012.01) |
| ***E21B 47/00*** | (2012.01) |
| *E21B 23/00* | (2006.01) |

(52) U.S. Cl.

CPC ..... *E21B 7/18* (2013.01); *E21B 7/06* (2013.01); *E21B 7/065* (2013.01); *E21B 17/20* (2013.01); *E21B 43/28* (2013.01); *E21B 47/00* (2013.01); *E21B 47/024* (2013.01); *E21B 23/004* (2013.01); *E21B 47/12* (2013.01)

(58) Field of Classification Search

CPC ..... E21B 7/18; E21B 7/065; E21B 43/292; E21B 47/024; E21B 47/12; E21B 43/25; E21B 17/20

See application file for complete search history.

(56) References Cited

U.S. PATENT DOCUMENTS

| | | | | |
|---|---|---|---|---|
| 4,462,765 | A | 7/1984 | Rodkin et al. | |
| 4,714,118 | A * | 12/1987 | Baker | E21B 7/065 175/162 |
| 4,787,465 | A * | 11/1988 | Dickinson, III | E21B 7/065 175/393 |
| 4,790,394 | A * | 12/1988 | Dickinson, III | E21B 7/065 175/340 |
| 4,930,586 | A * | 6/1990 | Turin | E21B 7/065 175/25 |
| 6,167,965 | B1 | 1/2001 | Bearden et al. | |
| 6,189,629 | B1 * | 2/2001 | McLeod | E21B 7/061 175/321 |
| 6,213,205 | B1 * | 4/2001 | Surjaatmadja | E21B 7/067 166/242.2 |
| 6,272,434 | B1 | 8/2001 | Wisler et al. | |
| 6,422,822 | B1 | 7/2002 | Holmes | |
| 6,470,978 | B2 * | 10/2002 | Trueman | E21B 4/18 175/424 |

(Continued)

OTHER PUBLICATIONS

Baker Hughes brochure for "EasyReach Extended-Reach Tool", accessed Jun. 30, 2017 via bakerhughes.com.*

*Primary Examiner* — Blake E Michener
(74) *Attorney, Agent, or Firm* — Shawn Hunter

(57) ABSTRACT

An acid tunneling system for forming lateral tunnels from a central wellbore. The acid tunneling system includes an acid tunneling tool having an acid injection nozzle which can be steered and oriented in response to downhole parameters that are detected and sent to surface in real time.

16 Claims, 9 Drawing Sheets

(56) References Cited

U.S. PATENT DOCUMENTS

| | | | | |
|---|---|---|---|---|
| 6,527,067 | B1 * | 3/2003 | Ravensbergen | E21B 41/0035 175/381 |
| 7,104,331 | B2 | 9/2006 | Bussear et al. | |
| 7,624,800 | B2 | 12/2009 | Jamieson et al. | |
| 7,665,975 | B2 | 2/2010 | Parmeter et al. | |
| 7,828,058 | B2 | 11/2010 | Fielder | |
| 8,061,426 | B2 * | 11/2011 | Surjaatmadja | E21B 41/0035 166/223 |
| 8,205,672 | B2 * | 6/2012 | Misselbrook | E21B 7/064 166/222 |
| 8,322,444 | B2 | 12/2012 | De Camargo | |
| 8,430,649 | B2 | 4/2013 | Albers et al. | |
| 8,471,551 | B2 | 6/2013 | Lake et al. | |
| 8,651,837 | B2 | 2/2014 | Tetzlaff | |
| 2002/0011357 | A1 * | 1/2002 | Trueman | E21B 4/18 175/67 |
| 2002/0023781 | A1 * | 2/2002 | Peters | C09K 8/72 175/67 |
| 2003/0234106 | A1 | 12/2003 | Surjaatmadja | |
| 2006/0157240 | A1 | 7/2006 | Shaw et al. | |
| 2006/0231258 | A1 * | 10/2006 | Head | E21B 29/06 166/298 |
| 2008/0257548 | A1 | 10/2008 | Shaw et al. | |
| 2008/0271925 | A1 | 11/2008 | Misselbrook et al. | |
| 2009/0114449 | A1 * | 5/2009 | Misselbrook | E21B 7/064 175/61 |
| 2009/0218143 | A1 * | 9/2009 | Sanfelice | E21B 7/061 175/62 |
| 2012/0061079 | A1 | 3/2012 | Buckman, Sr. et al. | |
| 2012/0138301 | A1 | 6/2012 | Assal et al. | |
| 2012/0312156 | A1 | 12/2012 | Standen et al. | |
| 2013/0272898 | A1 | 10/2013 | Toh et al. | |
| 2015/0144331 | A1 * | 5/2015 | Livescu | E21B 47/00 166/250.01 |

* cited by examiner

REAL TIME STEERABLE ACID TUNNELING SYSTEM

BACKGROUND OF THE INVENTION

1. Field of the Invention

The invention relates generally to systems and methods for creating steerable lateral subterranean tunnels and for monitoring formation of tunnels in real-time at surface.

2. Description of the Related Art

Sidetracking operations create lateral tunnels that extend outwardly from a central wellbore, which is typically substantially vertically-oriented, but might also be horizontally-oriented or inclined. A number of tools and techniques can be used to create lateral tunnels. Included among these tools and techniques are devices that inject acid into the wellbore and surrounding formation in order to dissolve rock. Devices of this type are used, for example, in the StimTunnel™ targeted acid placement service which is available commercially from Baker Hughes Incorporated of Houston, Tex. These acid stimulation devices typically use a bottom hole assembly with a pivotable wand with a nozzle through which acid is dispensed under high pressure. The acid helps dissolve portions of the formation around the nozzle. The wand is typically provided with one or more knuckle joints that help angle the nozzle in a desired direction. Features of this type of tool are discussed in U.S. Patent Publication No. 2008/0271925 ("Acid Tunneling Bottom Hole Assembly") by Misselbrook et al. [the '925 reference]. The '925 reference is herein incorporated by reference.

SUMMARY OF THE INVENTION

The present invention relates to devices and techniques for forming lateral tunnels from a subterranean wellbore using acid injection. Devices and methods of the present invention allow greater control of the direction and length of lateral tunnels being created than has been possible with conventional systems. Devices and methods of the present invention allow multiple lateral tunnels to be created radiating in different directions from a central, substantially vertical wellbore at a single depth or location along the wellbore. Devices and methods of the present invention allow for real-time monitoring, at surface, of details relating to the creation of lateral tunnels.

In accordance with particular embodiments, an acid tunneling system includes an acid-dispensing bottom hole assembly secured to a running arrangement for running into a wellbore. The bottom hole assembly includes a tunneling tool having a wand with a nozzle for injection of acid at desired locations to create lateral tunnels.

In preferred embodiments, the bottom hole assembly is provided with one or more downhole parameter sensors. The sensors are able to detect downhole parameters including pressure and temperature. In certain embodiments, the sensors are capable of detecting fluid flow parameters, such as density and viscosity. In a described embodiment, the sensors are retained within a sensor module that is incorporated into the bottom hole assembly.

In accordance with particular embodiments, a data/power cable is used to provide power to downhole components as well as a real-time data transmission system. Downhole parameters detected by the sensors is sent uphole by the cable to a controller. In accordance with preferred embodiments, the data/power cable is disposed within the central flowbore of the running string and may comprise a tube-wire type cable.

In a described embodiment, the acid tunneling system incorporates a casing collar locator ("CCL") which is useful for determining the position of the bottom hole assembly within a cased wellbore. When the acid tunneling system is run into a wellbore having portions that are lined with casing having collared connection, the casing collar locator provides an indication of the bottom hole assembly's depth or location within the wellbore. Casing collar locator data is transmitted to the controller at surface using the data/power cable.

In particular embodiments, the acid tunneling system includes an inclinometer which can determine the angular departure from vertical of the bottom hole assembly at any given point within the wellbore. This data is transmitted to the controller at surface. Together with data from the casing collar locator, if used, the inclinometer can be used to locate the bottom hole assembly at a particular desired location in the wellbore.

In accordance with particular embodiments, an indexing tool is incorporated into the bottom hole assembly and is useful to rotate the tunneling tool portion of the bottom hole assembly within the wellbore. Preferably, the indexing tool can rotate the tunneling tool up to 180 degrees in either radial direction, allowing the tunneling tool to form lateral tunnels in any radial direction outwardly from the central wellbore.

In certain embodiments, a pulsating tool, such as a lower frequency EasyReach extended reach tool, is connected between the tunneling tool and upper portions of the bottom hole assembly. The pulsating tool creates pressure waves that are transmitted to the tunneling tool and, in response to each pulse, the wand and nozzle of the tunneling tool are flexed radially outwardly to permit acid to be dispensed toward the surrounding formation.

In accordance with particular embodiments, the pulsating tool is designed to provide pressure waves having a pre-set pressure profile for bending the tunneling tool in a prescribed manner to form enlarged diameter lateral tunnels. The pulsating tool is designed to provide pressure pulses or waves which will activate flexure or bending of the tunneling tool in a periodic manner. In a particular embodiment, radial flexure of the tunneling tool occurs when the pulse is applied (pressure wave increasing) and the tool unflexes when the pulse is stopped (pressure wave decreasing). This flexing and unflexing will alternatively bend and straighten the tunneling tool so that wider tunnels are created. The inventors have determined that creating wider tunnels will advantageously reduce friction between the bottom hole assembly and the formation rock.

In operation, the acid tunneling system of the present invention can be operated to form lateral tunnels which extends outwardly from the central wellbore into which the acid tunneling system is run. In accordance with an exemplary method of operation, the acid tunneling system is run into a wellbore down to a formation into which it is desired to create lateral tunnels. The approximate location of the bottom hole assembly within the wellbore is determined using a data from a casing collar locator, inclinometer, sensors and/or by other means known in the art. Acid is flowed down through the flowbore of the running string, and the fluid pressure of the acid actuates the pulsating tool. The pulsating tool, in turn, actuates the tunneling tool to flex and unflex as acid is injected into the wellbore and creates lateral tunnels. The pulsating tool is also instrumental in creating lateral tunnels having larger diameters and which provide less frictional resistance with the tunneling tool, thereby facilitating the tunneling process.

The acid tunneling system of the present invention is steerable since it can be used to create tunnels in particular directions and at particular depths or locations in the wellbore. In certain embodiments, the acid tunneling system is steered by raising and lowering the running string within the wellbore based upon data provided by a casing collar locator or sensors. Further, the tunneling tool can be radially oriented by the indexing tool to direct the nozzle of the tunneling tool in a particular radial direction.

In a further described embodiment, a steerable acid tunneling system is used in conjunction with a milling tool to form one or more lateral tunnels from a cased wellbore. In this embodiment, a milling tool is first run into the wellbore and cuts one or more windows in the wellbore casing at locations wherein it is desired to create lateral tunnels using acid tunneling. Thereafter, the acid tunneling system is run into the wellbore and the acid tunneling tool is steered to form one or more lateral tunnels through the one or more lateral windows.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
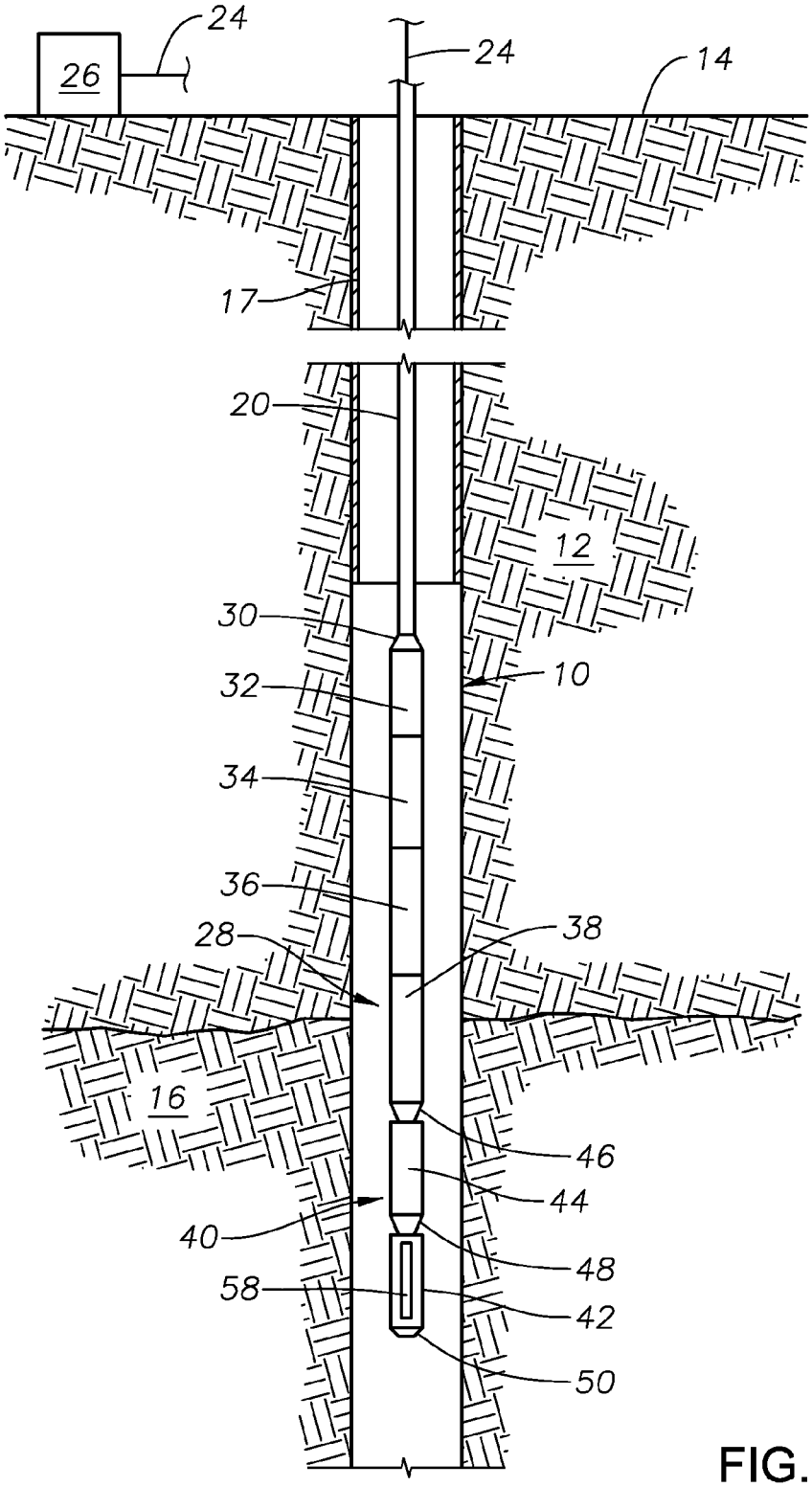
FIG. 1 is a side, cross-sectional view of an exemplary wellbore containing an acid tunneling system in accordance with the present invention.

FIG. 1 illustrates an exemplary wellbore 10 that has been drilled through the earth 12 from the surface 14 down to a hydrocarbon-bearing formation 16 into which it is desired to create lateral tunnels. The wellbore 10 has a portion that is lined with metallic casing 17, of a type known in the art. An acid tunneling system, generally indicated at 18 is disposed within the wellbore 10 from the surface 14. The acid tunneling system 18 includes a running string 20, which is preferably coiled tubing of a type known in the art.

Figure 2:
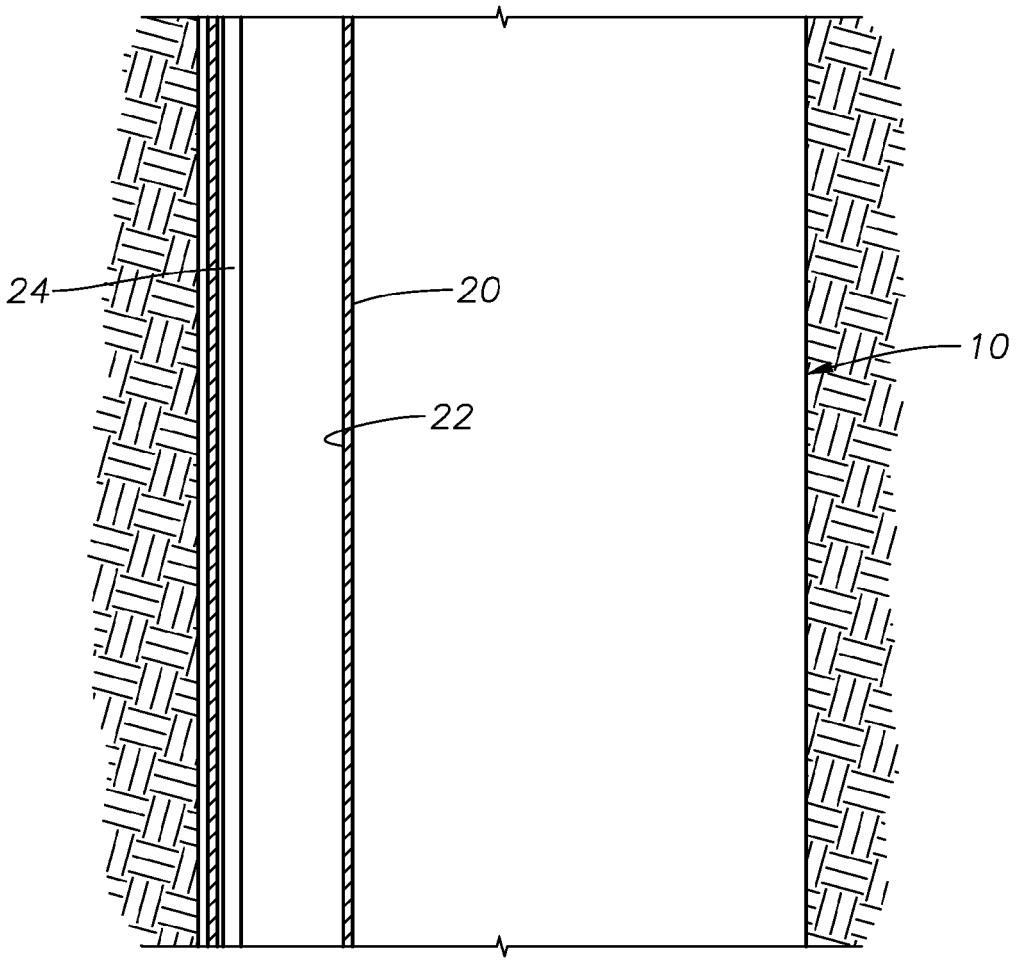
FIG. 2 is a side, cross-sectional view of a section of running string used with the acid tunneling system of FIG. 1.

As FIG. 2 illustrates, a central axial flowbore 22 is defined along the length of the running string 20. A cable 24 for transmission of electrical power and/or data extends along the length of the flowbore 22. According to preferred embodiments, the cable 24 is tube-wire. Tube-wire is a tube that contains an insulated cable that is used to provide electrical power and/or data to a bottom hole assembly or to transmit data from the bottom hole assembly to the surface 14. Tube-wire is available commercially from manufacturers such as Canada Tech Corporation of Calgary, Canada. Telecoil is coiled tubing which incorporates tube-wire that can transmit power and data.

At surface 14, a controller 26 receives data from the cable 24. The controller 26 is preferably a programmable data processor having suitable amounts of memory and storage for processing data received from a bottom hole assembly as well as means for displaying such data. In currently preferred embodiments, the controller 26 comprises a computer. In preferred embodiments, the controller 26 is programmed with a suitable geosteering software which is capable of using data collected from downhole sensors and providing guidance to an operator in real time to permit on the fly changes or the position and orientation of the tunneling tool 40. Suitable software for use by the controller 26 includes Reservoir Navigation Services (RNS) software which is available commercially from Baker Hughes Incorporated of Houston, Tex.

The acid tunneling system 18 includes a bottom hole assembly 28 that is secured to the running string 20 by a coiled tubing connector 30. The bottom hole assembly 28 is designed for the injection of acid and preferably includes a sensor module 32 and a casing collar locator 34. In the described embodiment, the bottom hole assembly 28 also includes an indexing tool 36 and a pulsating tool 38. Additionally, the bottom hole assembly 28 includes an acid tunneling tool 40.

In many respects, the acid tunneling tool 40 is constructed and operates in the same manner as the acid tunneling bottom hole assembly 100 described in U.S. Patent Publication 2008/0271925 by Misselbrook et al. The acid tunneling tool 40 includes a wand 42 and intermediate sub 44 which are affixed to the pulsating tool 38 by articulable knuckle joint 46. A second articulable knuckle joint 48 interconnects the wand 42 and the intermediate sub 44 together. The wand 42 has a nozzle 50 at its distal end. A suitable device for use as the acid tunneling tool 40 is the StimTunnel™ targeted acid placement tool which is available commercially from Baker Hughes Incorporated of Houston, Tex.

The indexing tool 36 is disposed axially between the hydraulic disconnect 34 and the pulsating tool 38. A suitable device for use as the indexing tool 36 is the coiled tubing Hi-Torque Indexing Tool which is available commercially from National Oilwell Varco. The indexing tool 36 is capable of rotating the pulsating tool 38 and acid tunneling tool 40 with respect to the running string 20 within the wellbore 10.

Figure 3:
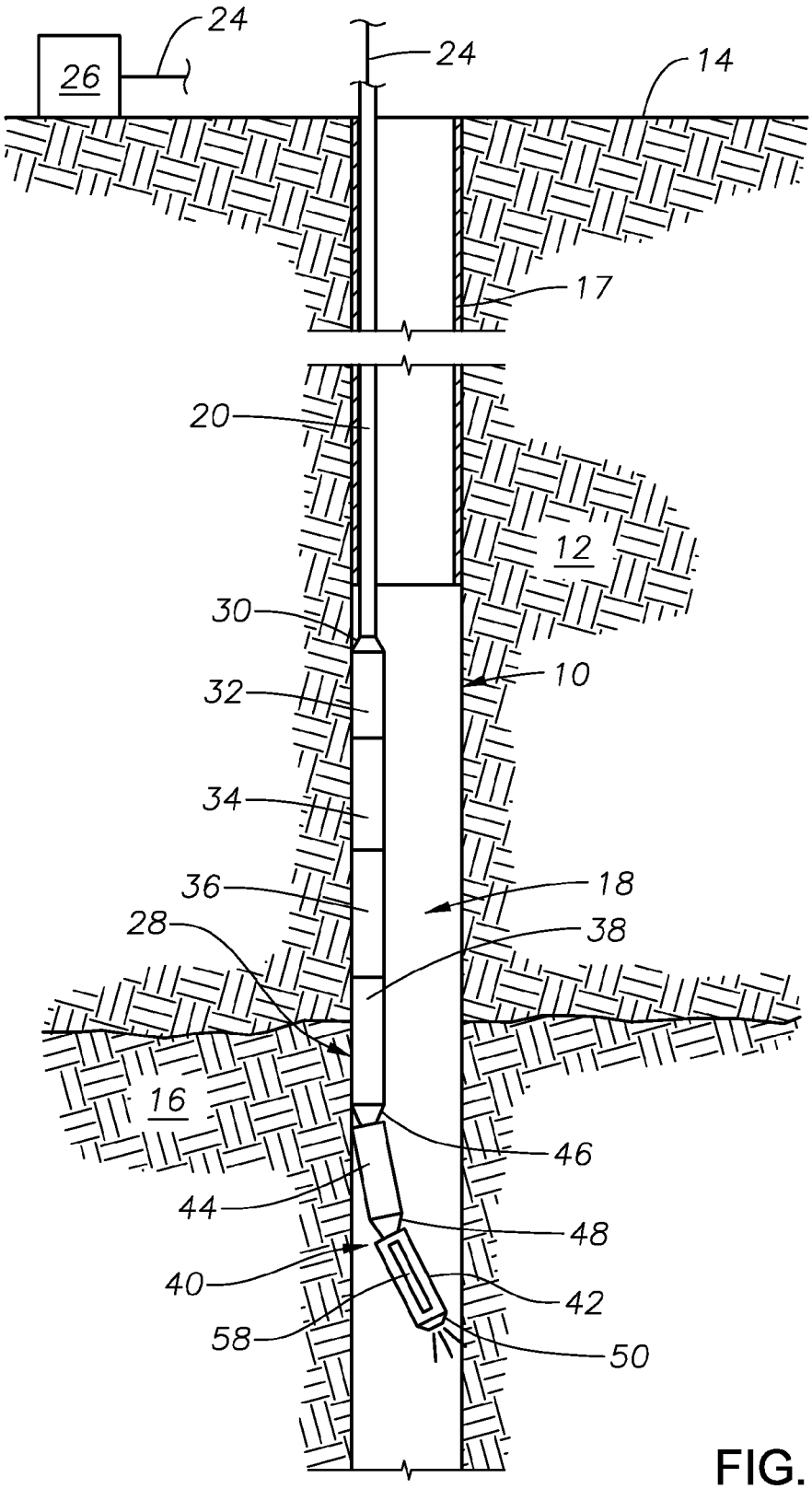
FIG. 3 is a side, cross-sectional view of the wellbore and acid tunneling system of FIG. 1, now with the acid tunneling tool having been flexed to engage the wellbore wall.
Figure 4:
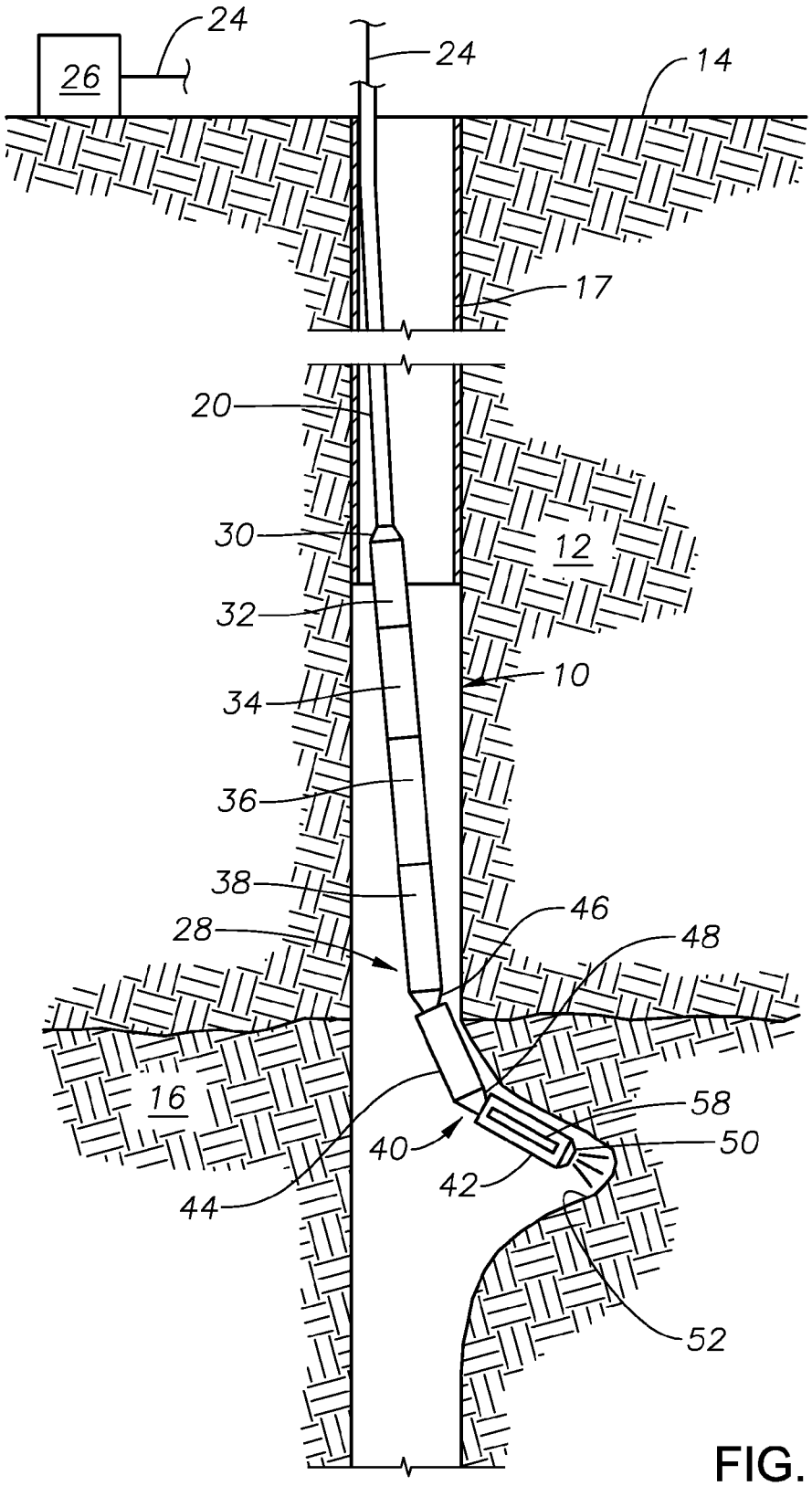
FIG. 4 is a side, cross-sectional view of the wellbore and acid tunneling system of FIGS. 1 and 3, now with the acid tunneling tool creating a lateral tunnel in the wellbore wall.

The bottom hole assembly 28 also includes a pulsating tool 38. A suitable device for use as the pulsating tool 38 is the EasyReach™ fluid hammer tool which is available commercially from Baker Hughes Incorporated of Houston, Tex. A fluid pulsing tool of this type is described in greater detail in U.S. Patent Publication No. 2012/0312156 by Standen et al. entitled "Fluidic Impulse Generator." In operation, fluid, such as acid, is flowed down through the flowbore 22 of the running string, and through the pulsating tool 38 toward the acid tunneling tool 40. The pulsating tool 38 creates pressure pulses within the fluid flowing to the acid tunneling tool 40, and these pulses will cause the wand 42 and intermediate sub 44 to be flexed or bent upon the first and second knuckle joints 46, 48. In currently preferred embodiments, the tunneling tool 40 will flex (flexed position shown in FIG. 3) upon receipt of a pulse and unflex (unflexed position shown in FIG. 1). Flexing of the tunneling tool 40 allows acid to be injected at an angle toward the wellbore 10 wall, as illustrated by FIGS. 3-4. Lateral tunnel 52 is shown in FIG. 4 being created by the injection of acid from nozzle 50.

Figure 6:
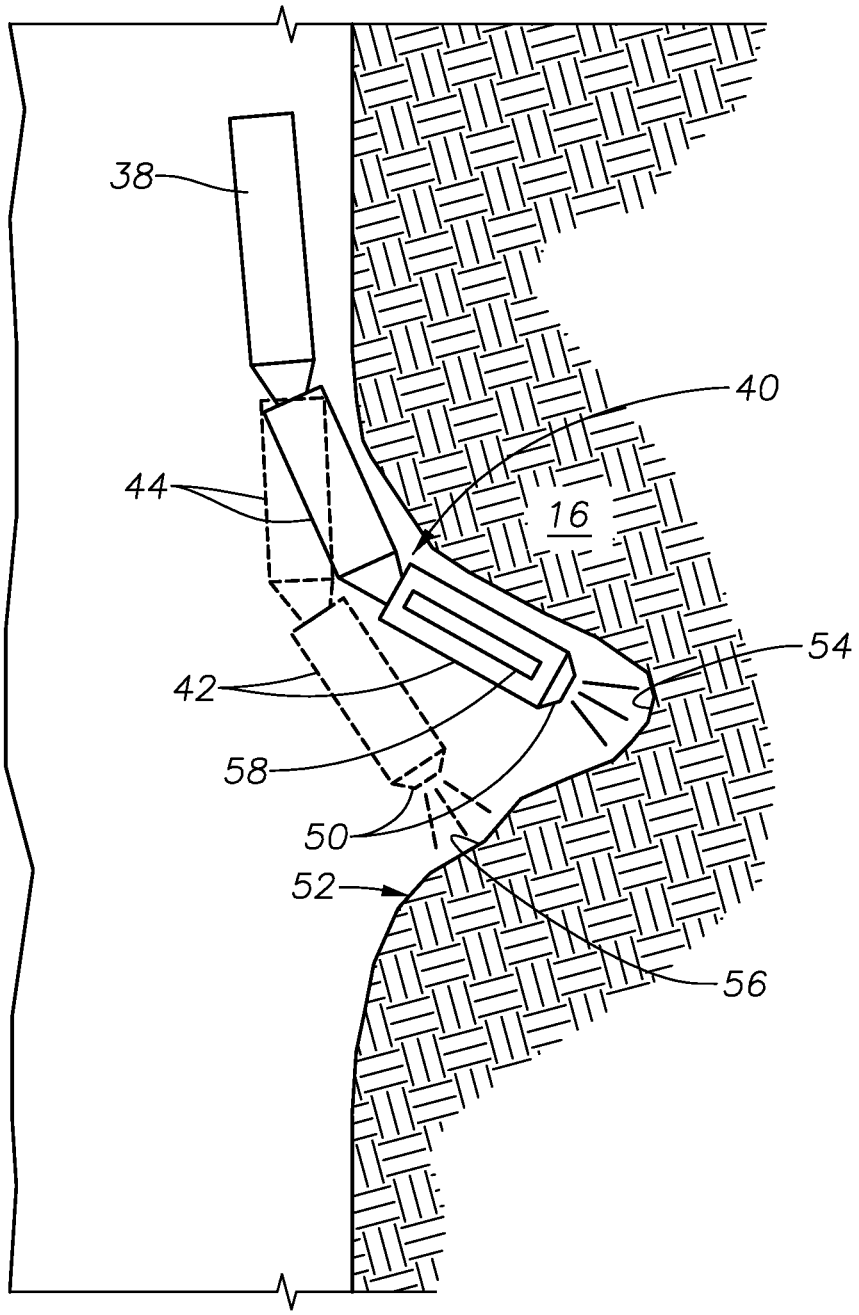
FIG. 6 is a side, cross-sectional view of the acid tunneling system forming an enlarged diameter lateral tunnel.

FIG. 6 illustrates the use of the pulsating tool 38 to help in creating an enlarged diameter lateral tunnel 52. In operation, the pulsating tool 38 generates a series of fluid pulses transmitted toward the tunneling tool 40. As each pulse is transmitted, the wand 42 and intermediate sub 44 flex to the first position shown by the solid lines in FIG. 6. When the pulse passes, the wand 42 and intermediate sub 44 unflex to the second position indicated by the broken lines in FIG. 6. As a result, the surface area of the formation 16 over which acid is distributed in increased, thereby enlarging the lateral tunnel. In particular, the lateral tunnel 52 will have acid distributed onto an upper portion 54 and a lower portion 56. Periodic flexing and unflexing, together with injection of acid, will create a lateral tunnel 52 having an enlarged diameter or wider portions as compared to acid tunneling tools which do not incorporate a pulsating tool. In addition, the enlargement of the lateral tunnel will result in reduced friction between the tunneling tool 40 and the formation 16 which will aid the process of forming the lateral tunnel 52.

In certain embodiments, an inclinometer 58 is incorporated into the tunneling tool 40. The inclinometer 58 is capable of determining the angular inclination of the tunneling tool 40, or portions thereof, with respect to a vertical axis or relative to the inclination or angle of the wellbore 10. The inclinometer 58 is electrically connected to the data/power cable 24 so that inclinometer data is sent to the controller 26 at surface 14 in real time. In addition, the sensor module 32 and casing collar locator 34 are electrically connected to the data/power cable 24 so that data obtained by them is provided to the controller 26 in real time.

The sensor module 32 includes sensors that are capable of detecting at least one downhole parameter. Preferably, the sensor module 32 includes sensors that are capable of detecting a variety of downhole parameters. Exemplary downhole parameters that are sensed by the sensor module 32 include temperature, pressure, gamma, acoustics and pH (acidity/alkalinity). These parameters can be used by the controller 26 or a user to identify the location and orientation of the bottom hole assembly 28 within the wellbore 10 in real time. For example, detected wellbore pressure or temperature can be correlated to a particular depth within the wellbore 10. In particular embodiments, real time bulk and azimuthal gamma measurements provided to the controller 26 from the sensor module 32 are used by the controller 26 in a manner similar to geosteering drilling techniques for determining in real time if the lateral tunnel 52 being formed is being created in the desired direction from the wellbore 10. In certain embodiments, sensed acoustics data is provided to the controller 26 from the sensor module 32 are used by the controller 26 for the same purpose. A pH sensor would be useful to provide information to the controller 26 which will help determine if acid is being spent effectively (i.e., reacting with formation rock) in forming lateral tunnel 52. A user can, in response, adjust acid volume, pumping rate, temperature and/or pressure.

The controller 26 will provide a user with the information needed to steer the tunneling tool 40 in real time in response to information provided to the controller 26 by the sensor module 32, inclinometer 58 and casing collar locator 34 used with the bottom hole assembly 28. The casing collar locator 34 is capable of providing location data as a result of detection of axial spacing from a casing collar (i.e., connecting collars used with the cased portion 17 of the wellbore 10. In the acid tunneling system 18 of the present invention, data from the casing collar locator 34 is provided to the controller in real time via data/power cable 24.

Figure 5:
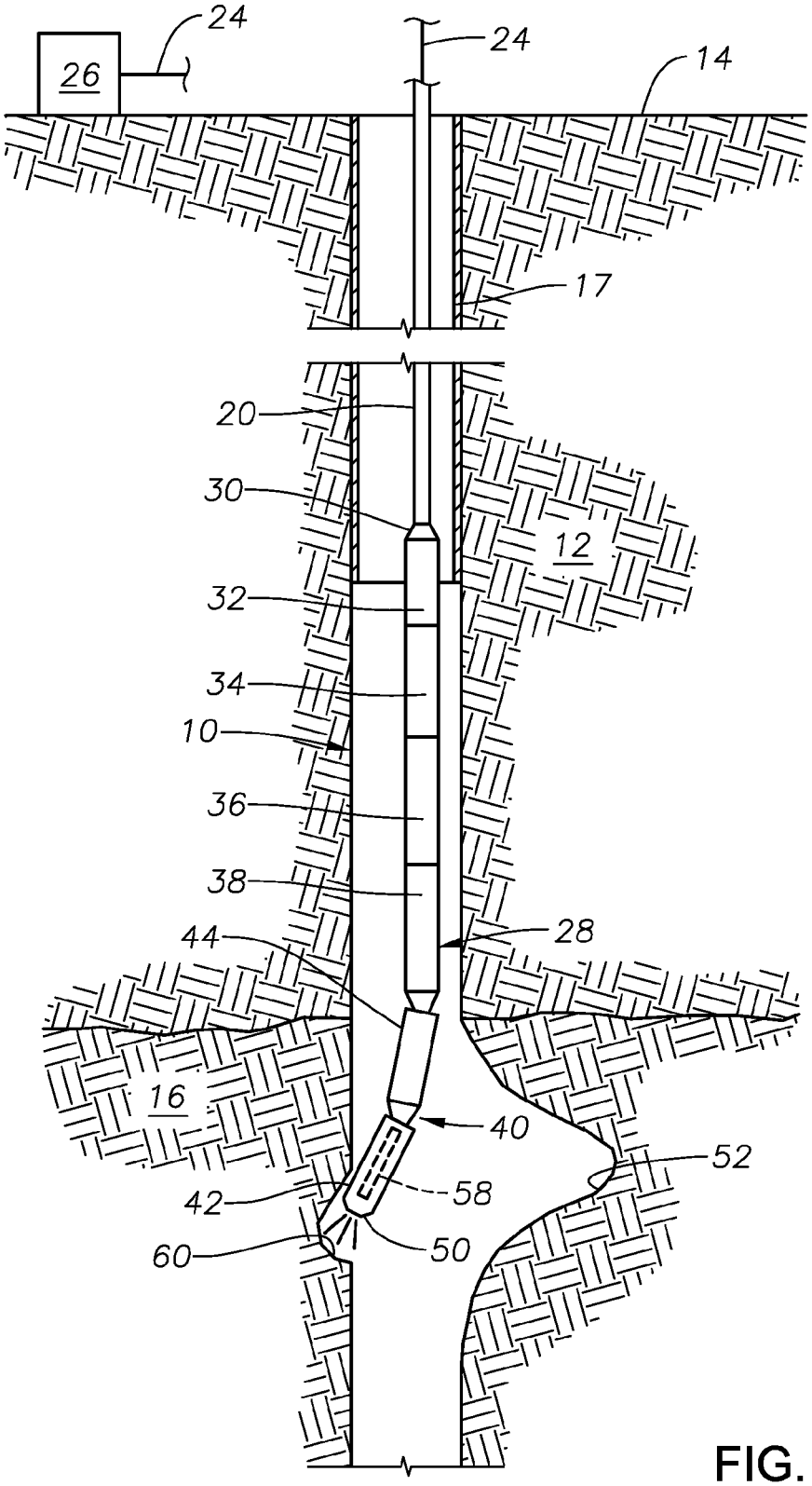
FIG. 5 is a side, cross-sectional view of the wellbore and acid tunneling system of FIGS. 1, 3 and 4, now with the acid tunneling tool having been rotated to create a second lateral tunnel.

In response to the information collected by the controller 26, a user can steer the bottom hole assembly 28 in order to create lateral tunnels at desired locations and in desired directions. With reference to FIG. 5, it can be seen that the tunneling tool 40 has been rotated in the wellbore 10 from the creation of first lateral tunnel 52 so that a second lateral tunnel 60 is being created by acid from the nozzle 50. The tunneling tool 40 has been rotated by the indexing tool 36 within the wellbore 10. In certain embodiments, the indexing tool 36 is capable of rotating the tunneling tool 40 up to 180 degrees in either radial direction within the wellbore 10, thereby providing the ability to orient the nozzle 50 of the tunneling tool 40 in any radial direction within the wellbore 10. Such real-time steering of the tunneling tool 40 can also be used to guide and orient the nozzle 50 of the tunneling tool 40 initially for the creation of lateral tunnel 52.

Figure 7:
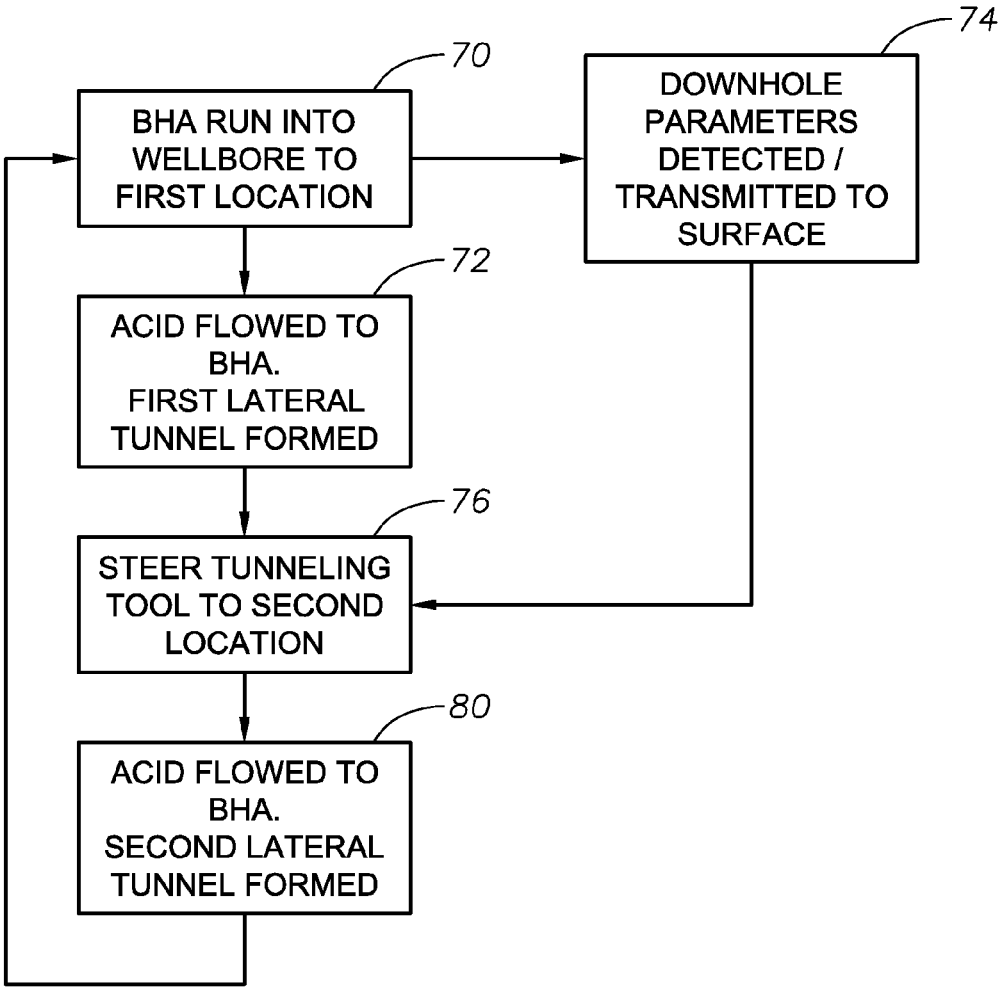
FIG. 7 is a flow diagram depicting steps in an exemplary acid tunneling system steering operation.

The invention provides systems and methods for steering a tunneling tool 40 in order to create lateral tunnels, such as tunnels 52, 60. In accordance with particular embodiments, data from downhole sensors and devices is transmitted to the surface in real time and, in response thereto, the tunneling tool 40 is moved axially within the wellbore 10 and/or angularly rotated within the wellbore 10 to steer and orient the nozzle 50 of that acid is injected in a desired direction for creation of one or more lateral tunnels. FIG. 7 provides an exemplary flow diagram depicting steps in an exemplary operation to steer the tunneling tool 40 to create lateral tunnels. In step 70, the bottom hole assembly 28 is run into wellbore 10 on running string 20 to a first desired location within the wellbore 10. In step 72, acid is flowed to the bottom hole assembly 28 where the pulsating tool 38 is activated to flex and unflex the tunneling tool 40 as described above. Acid creates a first lateral tunnel at a first location within the wellbore 10.

In step 74, data from sensor module 32, inclinometer 58, and casing collar locator 34 is transmitted to controller 26. It is noted that step 74 occurs during each of the steps 70 and 72. In step 76, the tunneling tool 40 is steered to orient the nozzle 50 to create a second lateral tunnel at a second location. A user steers the tunneling tool 40 in response to and based upon real-time downhole parameter data collected by the controller 26. In steering the tunneling tool 40, the bottom hole assembly 28 may be moved axially within the wellbore 10. Also, the indexing tool 36 can steer the tunneling tool 40 by rotating it within the wellbore 10. In step 78, the tunneling tool 40 creates a second lateral tunnel in a second location within the wellbore 10. In step 80, acid is flowed to the bottom hole assembly 28. The pulsating tool 38 flexes the tunneling tool 40 and directs the nozzle 50 radially outwardly so that a second lateral tunnel may be formed.

Figure 8:
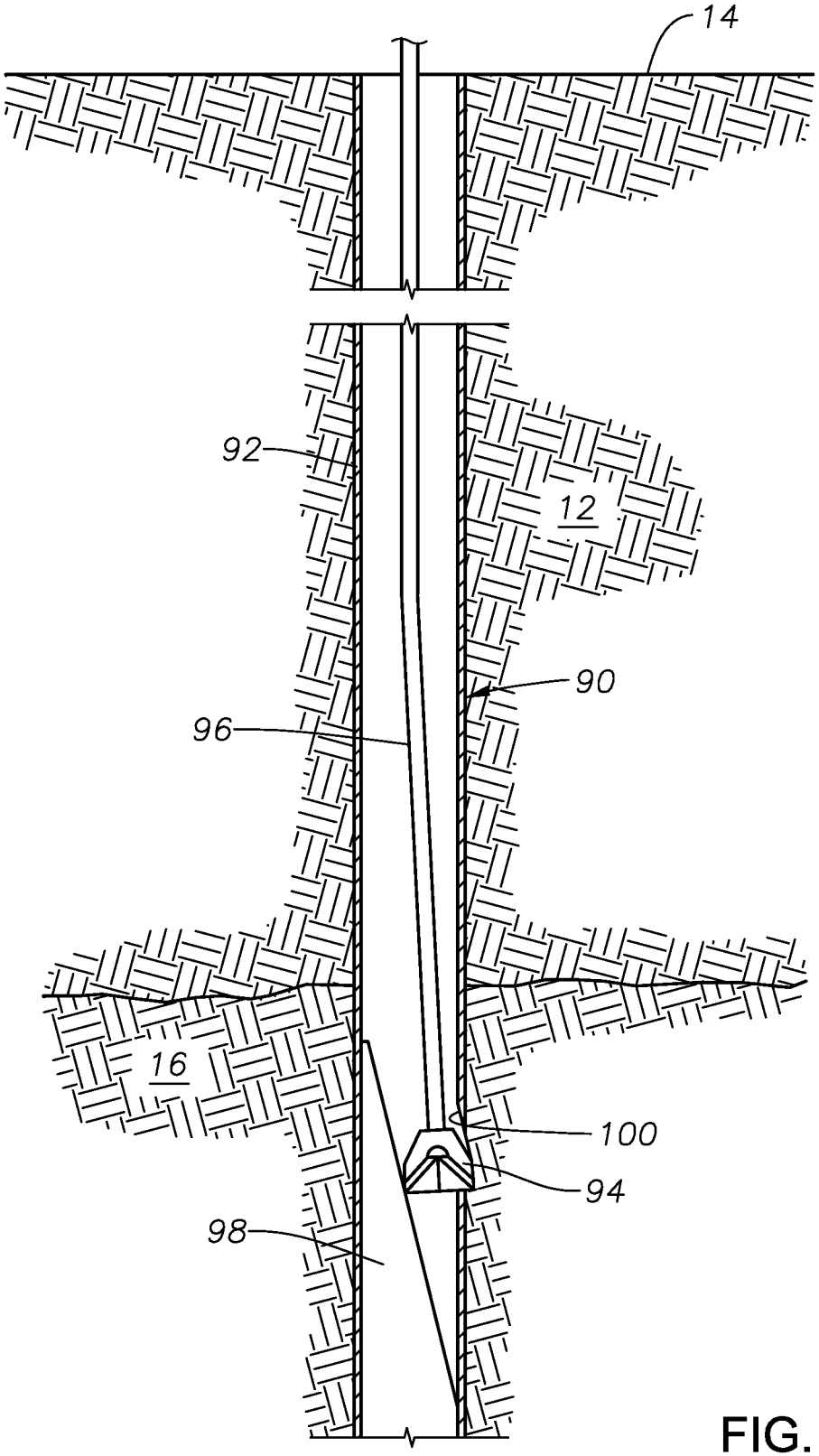
FIG. 8 is a side, cross-sectional view of an exemplary wellbore depicting a milling tool cutting a window in a cased wellbore.
Figure 9:
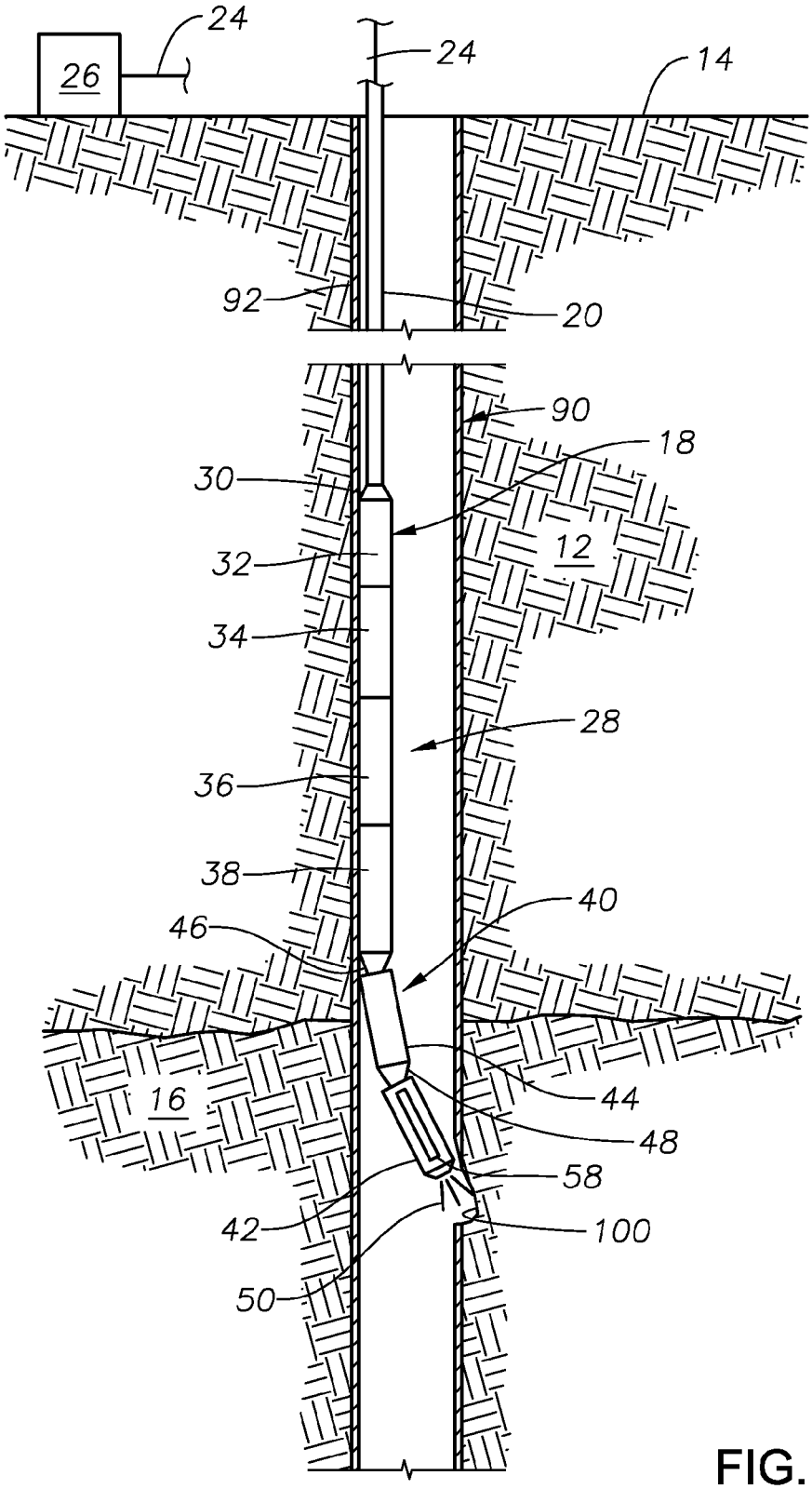
FIG. 9 is a side, cross-sectional view of the wellbore shown in FIG. 8 now with an acid tunneling system disposed within the wellbore to create a lateral tunnel.

FIGS. 8-9 depict an embodiment wherein an acid tunneling system is used to create one or more lateral tunnels from within a wellbore 90 which is lined with metallic casing 92. FIG. 8 illustrates a window mill 94 having been run into the wellbore 90 on running string 96. A whipstock 98 has been placed within the wellbore 90 deflects the mill 94 so that a window 100 is cut into the casing 92. The window 100 is cut at a location within the wellbore 90 wherein it is desired to create a lateral tunnel. Although only a single window 100 is shown being cut, it should be understood that more than one window may be cut, allowing lateral tunnels to be created at multiple locations from wellbore 90.

After the cutting of window 100 (or multiple windows, if applicable), the mill 94 and whipstock 98 are removed from the wellbore 90. Thereafter, an acid tunneling system 18 is disposed into the wellbore 90 (FIG. 9). The tunneling tool 40 of the acid tunneling system 18 is then steered, using the techniques described previously, to direct the nozzle 50 of the tunneling tool 40 toward the window 100 and surrounding formation 16. Steering in this instance will preferably utilize at least data provided to the controller 26 by the casing collar locator 34 in order to assist in properly locating the tunneling tool 40 at the same depth or location in the wellbore 90 as the window 100. Data from the inclinometer 58 is useful for directing the nozzle 50 through the window 100. If there are multiple windows that have been cut in the casing, the tunneling tool 40 is steered to each of them using the techniques described previously. At each location, the acid tunneling tool is used to create a lateral tunnel through the window, such as window 100.

Those of skill in the art will recognize that numerous modifications and changes may be made to the exemplary designs and embodiments described herein and that the invention is limited only by the claims that follow and any equivalents thereof.

What is claimed is:

1. A steerable acid tunneling system for creating lateral tunnels in a subterranean formation surrounding a wellbore, the steerable acid tunneling system comprising:

an acid tunneling tool having a wand with a nozzle for injecting acid into the formation and at least one articulable joint for angularly bending the wand within the wellbore;

one or more sensors for detection of at least one downhole parameter and transmission of a signal indicative of the at least one downhole parameter to surface; and wherein the acid tunneling tool is steered by a pulsating tool within the bottom hole assembly which creates pressure pulses that are transmitted to the acid tunneling tool to cause the at least one articulable joint to flex the wand in real time response to the at least one downhole parameter detected in order to inject acid in a particular direction.

2. The steerable acid tunneling system of claim 1 further comprising:

an indexing tool operably associated with the acid tunneling tool and operable to rotate the acid tunneling tool within the wellbore; and wherein the acid tunneling tool is further steered by rotating the acid tunneling tool within the wellbore with the indexing tool.

3. The steerable acid tunneling system of claim 1 wherein the at least one downhole parameter is at least one of a group consisting of pressure, temperature, tool inclination, axial spacing from a casing collar, alkalinity/acidity, gamma, and acoustics.

4. The steerable acid tunneling system of claim 1 wherein:

at least one of the one or more sensors comprises an inclinometer operably associated with tunneling tool; and the signal transmitted by the inclinometer is indicative of angular inclination of the tunneling tool within the wellbore.

5. The steerable acid tunneling system of claim 1 further comprising a controller to receive the signal.

6. The steerable acid tunneling system of claim 1 further comprising:

a running string for running a bottom hole assembly including the acid tunneling tool and one or more sensors into the wellbore, the running string having an axial flowbore for flowing of acid; and a power/data cable located within the flowbore for transmission of the signal to surface.

7. A steerable acid tunneling system for creating lateral tunnels in a subterranean formation surrounding a wellbore, the steerable acid tunneling system comprising:

an acid tunneling tool having a wand with a nozzle for injecting acid into the formation and at least one articulable joint for angularly bending the wand within the wellbore;

one or more sensors for detection of at least one downhole parameter and transmission of a signal indicative of the at least one downhole parameter to surface;

wherein the at least one downhole parameter is at least one of a group consisting of pressure, temperature, tool inclination, axial spacing from a casing collar, alkalinity/acidity, gamma, and acoustics;

wherein the acid tunneling tool is steered by a pulsating tool within the bottom hole assembly which creates pressure pulses that are transmitted to the acid tunneling tool to cause the at least one articulable joint to flex the wand in real time response to the at least one downhole parameter detected in order to inject acid in a particular direction.

8. The steerable acid tunneling system of claim 7 further comprising:

an indexing tool operably associated with the acid tunneling tool and operable to rotate the acid tunneling tool within the wellbore; and wherein the acid tunneling tool is further steered by rotating the acid tunneling tool within the wellbore with the indexing tool.

9. The steerable acid tunneling system of claim 7 wherein:

at least one of the one or more sensors comprises an inclinometer operably associated with tunneling tool; and the signal transmitted by the inclinometer is indicative of angular inclination of the tunneling tool within the wellbore to surface.

10. The steerable acid tunneling system of claim 7 further comprising a controller to receive the signal.

11. The steerable acid tunneling system of claim 7 further comprising:

a running string for running a bottom hole assembly including the acid tunneling tool and sensor into the wellbore, the running string having an axial flowbore for flowing of acid; and a power/data cable located within the flowbore for transmission of the signal to surface.

12. A method of steering an acid tunneling system in real time within a wellbore to create a lateral tunnel from the wellbore, the method comprising the steps of:

running an acid tunneling system into a wellbore, the acid tunneling system having an acid tunneling tool with a wand having a nozzle for injecting acid into the formation and at least one articulable joint for angularly bending the wand within the wellbore;

detecting at least one downhole parameter with one or more sensors and transmitting a signal indicative of the at least one downhole parameter to surface in real time;

steering the acid tunneling tool to a desired location for forming a lateral tunnel by transmitting pressure pulses from a downhole pulsating tool to the acid tunneling tool to cause the at least one articulable joint to flex the wand; and flowing acid to the acid tunneling tool to inject the acid into a formation at the desired location to form the lateral tunnel.

13. The method of claim 12 wherein the plurality of fluid pulses causes the wand to flex about the articulable joint between first and second positions so that the nozzle injects acid at the first and second positions, thereby enlarging the lateral tunnel formed.

14. The method of claim 12 wherein the step of steering the acid tunneling tool to a desired location further comprises rotating the acid tunneling tool within the wellbore.

15. The method of claim 12 wherein the step of steering the acid tunneling tool to a desired location further comprises moving the acid tunneling tool axially within the wellbore.

16. The method of claim 12 wherein:

the wellbore is lined with a metallic casing; and prior to running the acid tunneling system into the wellbore, a window is cut into the metallic casing, and thereafter, the acid tunneling tool is steered within the wellbore to the desired location.

* * * * *